US006808358B1

(12) United States Patent
Mayerberg, II et al.

(10) Patent No.: US 6,808,358 B1
(45) Date of Patent: Oct. 26, 2004

(54) CONVEYOR SYSTEM HAVING INCLINED STRUCTURE UTILIZING VACUUM AND AIR BEARING MEANS FOR FACILITATING EDGEWISE PRODUCT TRANSPORTATION

(75) Inventors: Willson L. Mayerberg, II, Skiatook, OK (US); Joe C. Bollinger, Tulsa, OK (US); Jack E. Olson, Tulsa, OK (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/459,518

(22) Filed: Jun. 12, 2003

(51) Int. Cl.[7] ..... B65G 35/00

(52) U.S. Cl. ..... 414/676; 198/88; 198/87; 198/193

(58) Field of Search ..... 414/676; 198/86, 198/88, 77, 87, 193, 93, 94

(56) References Cited

U.S. PATENT DOCUMENTS

| | | | | | |
|---|---|---|---|---|---|
| 3,301,603 | A | | 1/1967 | Boon | |
| 3,622,151 | A | * | 11/1971 | Range et al. | 406/87 |
| 3,734,567 | A | * | 5/1973 | Fong | 406/86 |
| 4,180,153 | A | | 12/1979 | Krishnan et al. | |
| 4,354,796 | A | | 10/1982 | Bergman | |
| 4,398,629 | A | | 8/1983 | Williamson | |
| 4,523,753 | A | * | 6/1985 | Hiromori et al. | 271/31.1 |
| 4,538,364 | A | * | 9/1985 | Jensen | 34/233 |
| 5,232,079 | A | | 8/1993 | Belcastro et al. | |
| 5,308,052 | A | * | 5/1994 | Roch et al. | 271/2 |
| 5,379,992 | A | * | 1/1995 | Holmes et al. | 271/2 |
| 5,947,258 | A | | 9/1999 | Yap et al. | |
| 6,045,278 | A | * | 4/2000 | Kubatzki et al. | 400/635 |
| 6,241,427 | B1 | * | 6/2001 | Hessburg et al. | 406/88 |
| 6,630,633 | B1 | * | 10/2003 | Uber et al. | 177/145 |

* cited by examiner

*Primary Examiner*—Richard Ridley
(74) *Attorney, Agent, or Firm*—Schwartz & Weinrieb

(57) ABSTRACT

An article or mail-piece conveyor system comprises a conveyor mechanism which has a substantially horizontally oriented product transportation surface upon which the articles can be conveyed in an upstanding mode as a result of the articles effectively being supported upon lower edge portions thereof, and an inclined surface against which the major or primary surface portions of each article is supported so as to permit the articles to be readily and easily conveyed by means of the horizontally oriented product transportation surface. Vacuum plenum chambers are fluidically connected to the inclined surface so as to withdraw ambient air from the article transportation path and thereby maintain the articles attracted to the inclined surface of the product transportation system, and in addition, positive air plenum chambers are also fluidically connected to the inclined surface so as to provide air to the article transportation path so as to effectively form an air bearing structure for the articles so as to facilitate the smooth and easy transportation of the articles along the transportation flow path in a relatively frictionless manner. Air discharge ports also facilitate the routing or sorting of the articles or mail pieces.

28 Claims, 3 Drawing Sheets

CONVEYOR SYSTEM HAVING INCLINED STRUCTURE UTILIZING VACUUM AND AIR BEARING MEANS FOR FACILITATING EDGEWISE PRODUCT TRANSPORTATION

FIELD OF THE INVENTION

The present invention relates generally to article or mail-piece conveyor systems, and more particularly to a new and improved product transportation system for conveying articles or mail pieces, wherein the product transportation system comprises a conveyor mechanism, which has a substantially horizontally oriented conveyor or product transportation surface upon which the articles, mail pieces, or products can be conveyed or transported in an upstanding mode as a result of the articles, mail pieces, or products effectively being supported upon lower edge portions thereof, and an inclined surface against which the major or primary surface portions, surface regions, or mass of each article, mail piece, or product is supported so as to permit the articles, mail pieces, or products to be readily and easily conveyed or transported by means of the horizontally oriented conveyor or product transportation surface, and wherein further, the inclined surface has integrally incorporated therein vacuum port or conduit structure through which air is effectively withdrawn from the article, mail piece, or product conveyor or transportation path so as to effectively maintain the articles, mail pieces, or products attracted to or adhered upon the inclined surface of the product transportation system, and in addition, the inclined surface also has integrally incorporated therein pneumatic output ports or conduits through which air is effectively simultaneously supplied to the article, mail piece, or product conveying or transportation path so as to effectively form an air bearing structure for the articles, mail pieces, or products so as to facilitate the smooth and easy conveyance or transportation of such articles, mail pieces, or products along the conveyor or product transportation flow path.

BACKGROUND OF THE INVENTION

Article conveyor systems conventionally comprise serially arranged pairs of conveyor belts for conveying the particular articles in a predetermined direction. Each one of the conveyor belts comprises a closed or endless loop structure wherein opposite ends of the closed or endless loop are respectively routed around rollers, at least one of which comprises a conveyor belt drive roller. The inner runs or inner portions of each pair of closed or endless looped conveyor belts are disposed immediately adjacent to each other in an opposed, side-by-side, or laterally or transversely spaced, mode with respect to each other along the direction of conveyance. In this manner, the opposed inner runs or inner portions of the conveyor belts cooperate together so as to effectively encounter and operatively engage the articles therebetween whereby the articles are effectively entrained with the opposed conveyor belts so as to be conveyed thereby in the predetermined direction of conveyance. The drive roller operatively associated with each conveyor belt is conventionally driven by means of a drive system which comprises, for example, a high-voltage electric drive motor and a mechanical drive system operatively interconnecting the electric motor output shaft and the rotary drive shaft upon which the drive roller is fixedly mounted. Such mechanical drive systems generate and radiate an inordinate amount of noise. In addition, while the electric drive motors, respectively associated with each one of the conveyor belts comprising each pair of oppositely disposed conveyor belts, can be suitably regulated so as to cause their output shafts to be rotated at a predetermined rotary speed which would, in turn, cause the conveyor belt drive rollers to likewise be rotated at the same rotary speed, due to various factors inherently characteristic of conventional conveyor belt drive systems, it often happens that the opposed conveyor belts are not in fact driven at the same lineal rate of speed.

Accordingly, a speed differential effectively exists between the oppositely disposed inner runs or inner portions of the opposed conveyor belts, and when these oppositely disposed inner runs or inner portions of the opposed conveyor belts, being operated at their different lineal rates of speed, operatively engage the opposite surface portions of the articles being conveyed between and by the oppositely disposed inner runs or inner portions of the opposed conveyor belts, serious operational and environmental problems occur. More particularly, as a result of the engagement of the opposite surface portions of the articles by the oppositely disposed inner runs or inner portions of the opposed conveyor belts conveying the articles along the longitudinal extent of the overall conveyor system, frictional forces are generated between the opposite surface portions of the articles and the oppositely disposed inner runs or inner portions of the opposed conveyor belts as a result of the effective mechanical scrubbing of the opposite surface portions of the articles by the oppositely disposed inner runs or inner portions of the opposed conveyor belts. In light of such mechanical scrubbing of the opposite surface portions of the articles by the oppositely disposed inner runs or inner portions of the opposed conveyor belts, the articles being conveyed by the opposed conveyor belts are subjected to highly erosive forces. These highly erosive forces not only effectively compromise the structural integrity of each article being conveyed by the opposed conveyor belts, but in addition, result in the generation of atmospherically suspended cellulose particulates which not only constitute a human health hazard but, still further, present a potentially explosive atmospheric condition and hazardous work environment.

Continuing still further, it is noted that, as a result of the employment of the aforenoted type of article or product conveyor or transportation system, that is, an article or product conveyor system comprising pairs of oppositely disposed conveyor belts wherein the articles, mail pieces, or products are conveyed as a result of being effectively entrained between the oppositely disposed inner runs or inner portions of the oppositely disposed conveyor belts, the articles, mail pieces, or products that can readily be conveyed or transported by means of such article or product conveyor or transportation systems is limited. More particularly, the articles, mail pieces, or products that can be successfully or viably conveyed or transported by means of such article or product conveyor or transportation systems cannot have thickness dimensions which exceed predetermined values or limits. Accordingly, it is often problematic to utilize such article or product conveyor or transportation systems in order to convey or transport relatively bulky articles or products, such as, for example, literature, greeting card packages, pharmaceutical packages, and the like. In addition, the articles, mail pieces, or products must have a predetermined degree of inherent rigidity. Accordingly, it is likewise often problematic to utilize such article or product conveyor or transportation systems in order to convey or transport, for example, newspapers or magazines which are characterized by means of a low level of inherent rigidity.

Various other types of article or product conveyor or transportation systems are of course well known in the art and industry whereby, for example, typically bulky articles or packages can in fact be conveyed or transported thereby, however, such conveyor or transportation systems usually or often exhibit additional operational drawbacks or disadvantages in connection with, for example, article or product logistics, sorting, or routing. For example, bulky or non-rigid articles or products can be placed upon a horizontally disposed or oriented roller conveyor, but due to various factors inherent to the conveyance or transportation of the articles or products, the articles or products may be jostled, subjected to vibrations, or the like, whereby the predetermined orientation of the articles or products upon the conveyor may become altered. This alteration in the orientation of the articles or products upon the conveyor can prove to be problematic because if the articles or products need to be scanned at a downstream location in order to properly route or convey the same to a predetermined destination, the bar code or other indicia present upon the article or product may no longer be capable of being properly scanned or read by automatic apparatus. Still further, since the articles or products, located upon the horizontally disposed roller conveyor, are supported upon the conveying surface portion of the conveyor by means of a primary surface or side wall portion of the article or product, substantial surface-to-surface contact is defined between the article or product and the transportation conveyor. Accordingly, substantial friction forces are defined or generated between the surfaces of the article or product and the transportation conveyor mechanism whereby, for example, in order to remove the article or product from the transportation conveyor in accordance with different routing or sorting programs or techniques, substantial forces must be applied to the article or product in order to effectively disengage the article or product from the transportation conveyor.

Still further, in the instance where magazines or newspapers are being conveyed, for example, as a result of being disposed in a flat state upon a roller conveyor, if various implements, physical or mechanical, pneumatic, or the like, are utilized to move the magazines or newspapers with respect to the roller conveyor in an effort to remove the same therefrom in accordance with particular routing or sorting techniques, it is sometimes operationally difficult for the implements to properly engage the newspapers or magazines. The reason for this is that as a result of the disposition or orientation of the newspapers or magazines upon the conveyor in the aforenoted flat state, the operative area profiles of the newspapers or magazines which are effectively exposed to such implements is relatively small. Therefore, the implements for moving the articles or products upon the conveyor, or for removing the articles or products from the conveyor, must either be specially constructed in order to perform such operations, or must be capable of exerting or generating substantially large force values.

A need therefore exists in the art for a new and improved article or product conveyor or transportation system wherein diverse types of articles or products, comprising, for example, bulky articles or products having relatively large or irregular thickness dimensions, or articles or products having a relatively low level of rigidity, such as, for example, newspapers or magazines, can be readily transported or conveyed, and in addition, the articles or products can also be easily maintained upon the conveyor or transportation mechanism as well as easily controlled for achieving proper routing, sorting, and processing of the same without the need for the apparatus or system to comprise specially constructed implements, or for the apparatus or system to include implements which can in fact exert or generate substantially large force levels or values in order to achieve the aforenoted routing, sorting, or processing of the articles or products.

OBJECTS OF THE INVENTION

Accordingly, it is an object of the present invention to provide a new and improved article, mail piece, or product conveyor or transportation system.

Another object of the present invention is to provide a new and improved article, mail piece, or product conveyor or transportation system which effectively overcomes the various operational disadvantages and drawbacks characteristic of conventional PRIOR ART conveyor or transportation systems.

An additional object of the present invention is to provide a new and improved article, mail piece, or product conveyor or transportation system which is capable of conveying or transporting articles, mail pieces, or products that may have diverse thickness dimensions and/or inherent rigidity characteristics.

A further object of the present invention is to provide a new and improved article, mail piece, or product conveyor or transportation system which is capable of conveying or transporting articles, mail pieces, or products, that may have diverse thickness dimensions and/or inherent rigidity characteristics, in such a manner that the individual articles, mail pieces, or products are positively retained upon the conveyor or transportation mechanism, and yet the conveyance of the articles, mail pieces, or products upon the conveyor or transportation mechanism is also positively facilitated such that the articles, mail pieces, or products can be easily, rapidly, and assuredly conveyed or transported.

A last object of the present invention is to provide a new and improved article, mail piece, or product conveyor or transportation system which is capable of conveying or transporting articles, mail pieces, or products, that may have diverse thickness dimensions and/or inherent rigidity characteristics, in such a manner that the individual articles, mail pieces, or products are positively retained upon the conveyor or transportation mechanism, and yet the conveyance of the articles, mail pieces, or products upon the conveyor or transportation mechanism is also positively facilitated such that the articles, mail pieces, or products can be easily, rapidly, and assuredly conveyed or transported so as to assure routing, sorting, and further processing of the articles, mail pieces, or products.

SUMMARY OF THE INVENTION

The foregoing and other objectives are achieved in accordance with the teachings and principles of the present invention through the provision of a new and improved article, mail piece, or product conveyor or transportation system which comprises a conveyor mechanism, which has a substantially horizontally oriented conveyor or product transportation surface upon which the articles, mail pieces, or products can be conveyed or transported in an upstanding mode as a result of the articles, mail pieces, or products effectively being supported upon lower edge portions thereof, and an inclined surface against which the major or primary surface portions, surface regions, or mass of each article, mail piece, or product is supported so as to permit the articles, mail pieces, or products to be readily and easily conveyed or transported by means of the horizontally oriented conveyor or product transportation surface. The inclined surface has integrally incorporated therein vacuum plenum chambers through which air is effectively withdrawn from the article, mail piece, or product conveyor or transportation path so as to effectively maintain the articles, mail pieces, or products attracted to or adhered upon the inclined surface of the product transportation system, and in addition, the inclined surface also has integrally incorporated therein positive air supply plenum chambers through which air is effectively simultaneously supplied to the article, mail piece, or product conveying or transportation path so as to effectively form an air bearing structure for the articles, mail pieces, or products so as to facilitate the smooth and easy conveyance or transportation of such articles, mail pieces, or products along the conveyor or product transportation flow path.

Still further, the entire article, mail piece, or product conveyor or transportation system is pivotal around a lower corner region thereof so as to effectively alter the relative inclination of both the horizontally oriented conveyor or product transportation surface, upon which the articles, mail pieces, or products are conveyed or transported, as well as the inclined surface against which the major or primary surface portions, surface regions, or mass of each article, mail piece, or product is supported. In this manner, predetermined alterations can be made to the article, mail piece, or product conveyor or transportation system in order to partially adjust the gravitational support of the diverse articles, mail pieces, or products being conveyed along the horizontally oriented conveyor or product transportation surface. Accordingly, regardless of the weight of any of the particular articles, mail pieces, or products being conveyed by means of the conveyor or transportation system, all articles, mail pieces, or products can be readily, easily, and quickly conveyed or transported along the horizontally oriented conveyor or product transportation surface so as to achieve the ultimate routing, sorting, and further processing of the articles, mail pieces, or products.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 3:
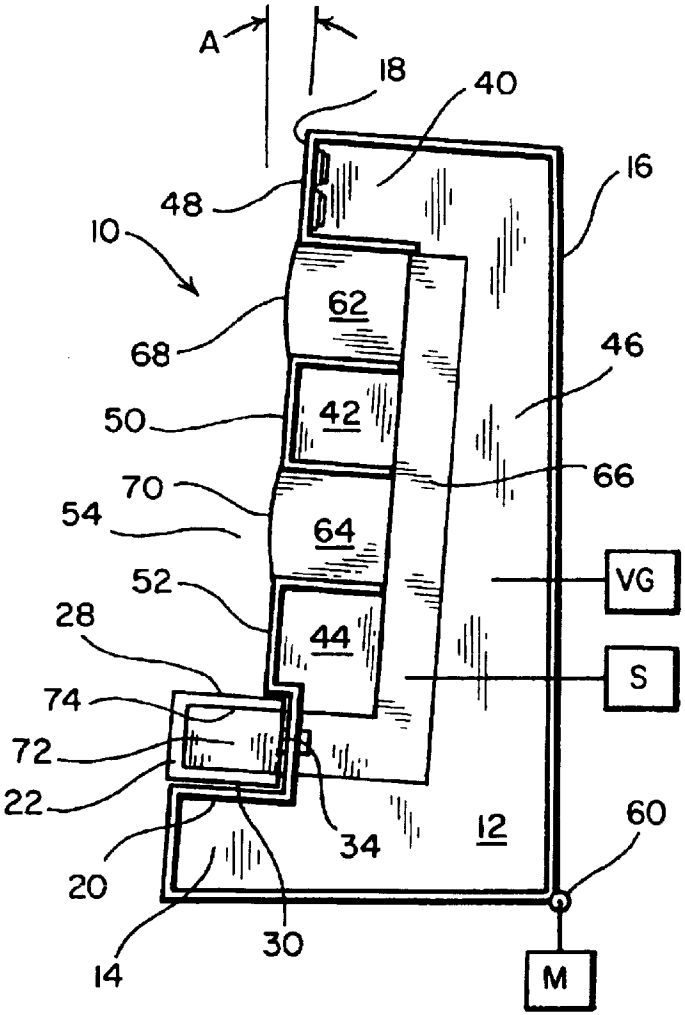
FIG. 3 is a right side elevational view of the new and improved article, mail piece, or product conveyor or transportation system, as disclosed within FIGS. 1 and 2 and corresponding to the inclined disclosure of FIG. 2, and particularly disclosing the vacuum generator and air supply source.
Figure 1:
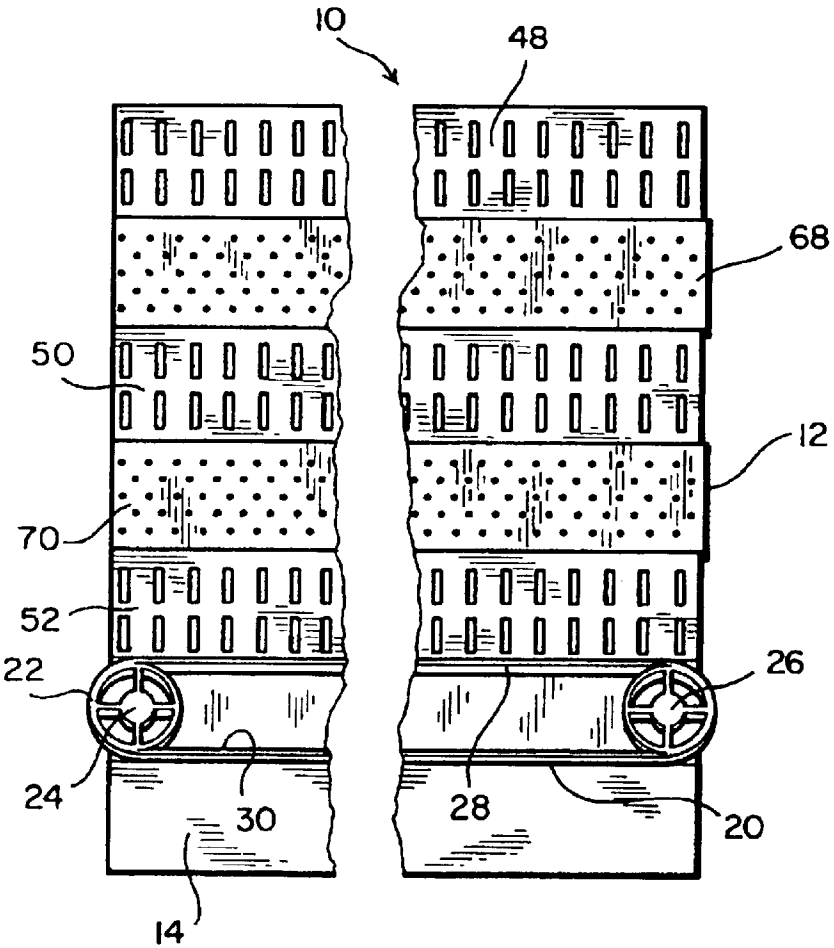
FIG. 1 is a front elevational view of a new and improved article, mail piece, or product conveyor or transportation system which has been constructed in accordance with the principles and teachings of the present invention and which discloses the various operative components thereof.
Figure 2:
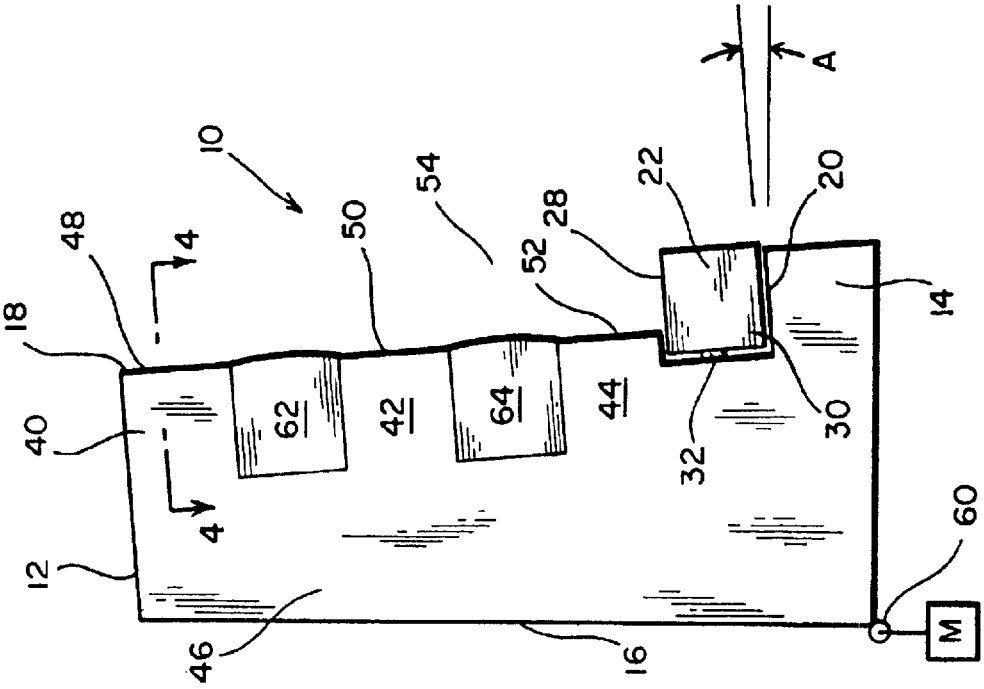
FIG. 2 is a left side elevational view of the new and improved article, mail piece, or product conveyor or transportation system as disclosed within FIG. 1 showing the inclination of the horizontally movable conveyor mechanism as well as the inclination of the vertical support surface.

Referring now to the drawings, and more particularly to FIGS. 1–3 thereof, a new and improved article, mail piece, or product conveyor or transportation system, which has been constructed in accordance with the principles and teachings of the present invention and which discloses the various operative components thereof, is generally indicated by the reference character 10. As can readily be appreciated, the new and improved article, mail piece, or product conveyor or transportation system 10 is seen to comprise a housing structure 12 which, as can best be appreciated from FIGS. 2 and 3, has a substantially L-shaped cross-sectional configuration. More particularly, it is seen that the L-shaped housing structure 12 comprises, in effect, a relatively small horizontally oriented leg section 14 and a relatively large upstanding or vertically oriented leg section 16. The relatively large upstanding or vertically oriented leg section 16 comprises a front surface region 18, and it is seen that the relatively small horizontally oriented leg section 14 is seen to effectively project outwardly and forwardly from the front surface region 18. Consequently, as a result of the outward or forward projection of the relatively small horizontally oriented leg section 14 of the housing structure 12, with respect to the front surface region 18 of the relatively large upstanding or vertically oriented leg section 16 of the housing structure 12, a substantially horizontally disposed ledge portion 20 is defined atop the relatively small horizontally oriented leg section 14 of the housing structure 12. It is also noted that the substantially horizontally disposed ledge portion 20 is actually disposed at a predetermined angle A with respect to a true horizontal plane for a purpose to be discussed shortly hereinafter.

Figure 5:
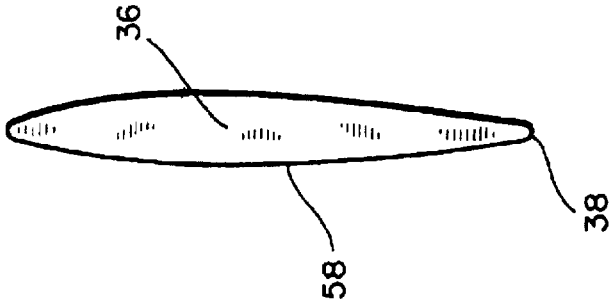
FIG. 5 is an end elevational view of an exemplary article, mail piece, or product which can be conveyed by means of the new and improved article, mail piece, or product conveyor or transportation system of the present invention as disclosed within FIGS. 1–4.
Figure 4:
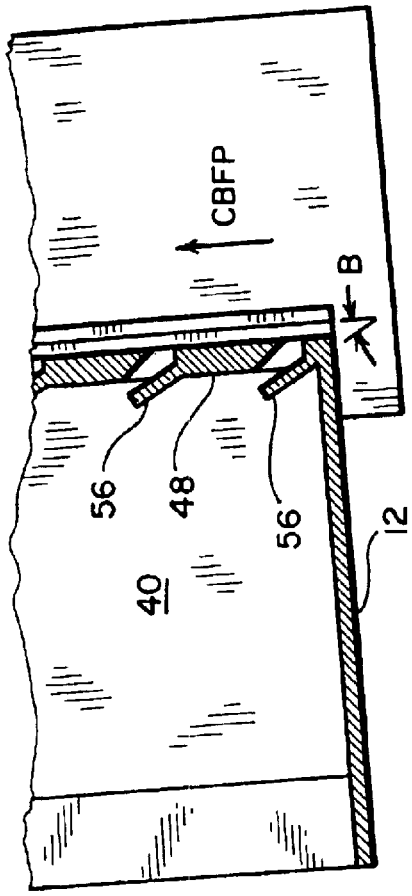
FIG. 4 is a partial cross-sectional view of the new and improved article, mail piece, or product conveyor or transportation system, as disclosed within FIG. 2 as taken along the lines 4—4 of FIG. 2, showing the vacuum plenum chamber louver structure.

In accordance with an additional structural feature characteristic of the new and improved article, mail piece, or product conveyor or transportation system 10 of the present invention, and with reference continuing to be made to FIGS. 1–3, it is seen that an endless loop conveyor belt mechanism 22 is drivingly mounted within the lower end portion of the housing structure 12 so as to be positioned immediately above the horizontally disposed ledge portion 20. More particularly, it is seen that the endless loop conveyor belt mechanism 22 is routed around a pair of rollers 24,26, at least one of which comprises a drive roller, and in this manner, an upper conveyor belt conveying run is defined at 28 while a lower conveyor belt return run is defined at 30. The rollers 24,26 are rotatably mounted within the lower end portion of the housing structure 12 by means of roller shafts 32,34, and as a result of this mounted arrangement of the conveyor belt mechanism 22 within the lower section or region of the housing structure 12, and in particular, as a result of the disposition or provision of the upper conveying run 28 of the conveyor belt mechanism 22 above the substantially horizontally disposed ledge portion 20 of the housing structure 12, the upper conveyor belt conveying run 28 serves as a conveying surface upon which the articles, mail pieces, or products, an exemplary one of which is disclosed within FIG. 5 as at 36, can be conveyingly supported.

In particular, it is to be noted that in accordance with the principles and teachings of the present invention, each article, mail piece, or product 36 is adapted to be conveyingly supported upon the upper conveying run 28 of the conveyor belt mechanism 22 in a substantially upright mode as a result of the particular article, mail piece, or product 36 being supported upon the upper conveying run 28 of the conveyor belt mechanism 22 by means of its lower edge portion 38. In this manner, due to the relatively small surface area defined by means of the lower edge portion 38 of the typical article, mail piece, or product 36, which is adapted to be disposed in surface contact with the upper conveying run 28 of the conveyor belt mechanism 22 when the article, mail piece, or product 36 is adapted to be conveyed by means of the upper conveying run 28 of the conveyor belt mechanism 22, the amount of friction defined between the lower edge portion 38 of the typical article, mail product or mail piece 36 and the upper conveying run 28 of the conveyor belt mechanism 22 is relatively small. Accordingly, this enables or facilitates the controlled movement of the article, mail piece, or product 36 with respect to the conveyor belt mechanism 22 in order to, in turn, facilitate or achieve the particular routing, sorting, and further processing of the articles, mail pieces, or products 36 as desired.

It is further noted, in accordance with additional principles and teachings of the present invention, and in order to facilitate the conveyance of the articles, mail pieces, or products 36 in the aforenoted upright mode upon the upper conveying run 28 of the conveyor belt mechanism 22, that the relatively large upstanding or vertically oriented leg section 16 of the housing structure 12 is seen to comprise, as can best be appreciated from FIGS. 1–4, a plurality of vertically separated vacuum plenum chambers 40,42,44. All of the vacuum plenum chambers 40,42,44 are fluidically connected to a common vacuum plenum chamber 46 which is defined within the interior of the relatively large upstanding or vertically oriented leg section 16 of the housing structure 12, and a suitable vacuum source or vacuum generator VG is, in turn, fluidically connected to common vacuum plenum chamber 46. The vacuum source or vacuum generator VG can effectively develop or generate a suitable vacuum level, such as, for example, within the range of 2.0–2.5 psi, and the front surface of each vacuum plenum chamber 40,42,44 is provided with a louvered face plate 48,50,52. Accordingly, as a result of the operation of the vacuum generator or vacuum source VG, ambient air can effectively be withdrawn from the conveyor flow path region 54 which is disposed immediately above the upper conveyor belt conveying run 28 of the conveyor belt mechanism 22.

It is noted that each one of the louvered face plates 48,50,52 is provided with a plurality of louvers 56, which are oriented at a predetermined angle B with respect to the conveyor belt flow path CBFP along which the plurality of articles, mail pieces, or products 36 are being conveyed or transported. In this manner, as the plurality of articles, mail pieces, or products 36 are conveyed along the upper conveying run 28 of the conveyor belt mechanism 22, and while the plurality of articles, mail products, or mail pieces 36 are disposed within their upright or upstanding modes wherein the lower edge portions 38 of the plurality of articles, mail pieces, or products 36 are disposed in contact with and are supported upon the upper conveying run 28 of the conveyor belt mechanism 22, the vacuum source or vacuum generator VG can effectively develop or generate vacuum or negative air pressure flow forces which can effectively interact with a primary side surface portion 58 of each article, mail piece, or product 36 so as to cause the plurality of articles, mail pieces, or products 36 to be attracted toward or effectively adhered upon the front surface 18 of the housing structure 12. Accordingly, the articles, mail pieces, or products 36, particularly in the instance that the articles, mail pieces, or products comprise, for example, newspapers, magazines, advertising fliers or leaflets, or the like, are able to in fact be conveyed along the upper conveying run 28 of the conveyor belt mechanism 22 in a stable manner. In order to further assist the conveyance of the articles, mail pieces, or products 36 along the upper conveying run 28 of the conveyor belt mechanism 22 in the aforenoted stabilized upright or upstanding manner, it is noted that, as may best be appreciated from FIGS. 2 and 3, the front surface 18 of the housing structure 12 is inclined from a true vertical plane through means of an angle A which substantially corresponds to the inclination of the ledge portion 20 of the housing structure 12, and the similar inclined orientation of the upper conveying run 28 of the conveyor belt mechanism 22. In this manner, the inclined upper conveying run 28 of the conveyor belt mechanism 22 and the inclined front surface 18 of the housing structure 12 cooperate together so as to properly and stably support the articles, mail pieces, or products 36 while the same are conveyed along the upper conveying run 28 of the conveyor belt mechanism 22.

It is noted still further, in accordance with additional principles and teachings of the present invention, that the entire housing structure 12 is adapted to be pivotally movable about a horizontally disposed longitudinal axis defined by means of a pivot shaft mechanism 60 to which the lower rear corner region of the housing structure 12 is fixedly attached. A suitable motor drive M is operatively connected to the pivot shaft mechanism 60, and in this manner, the housing structure 12 may be pivoted or tilted so as to predeterminedly alter the angles A,A at which the front surface 18 of the housing structure 12 is disposed with respect to a true vertical plane, and at which the upper conveying run 28 of the conveyor belt mechanism 22 is disposed with respect to a true horizontal plane. Such alterations in the angles A,A permits the system 10 to readily adapt to the different weight or mass characteristics of the diverse articles, mail pieces, or products 36 being conveyed or transported so as to effectively balance or optimally distribute the individual and resultant weight, support, or gravitational forces of the diverse types of articles, mail pieces, or products 36 upon and between the front surface 18 of the housing structure 12 and the upper conveying run 28 of the conveyor belt mechanism 22. In particular, the angles A,A may be varied anywhere within the range of 5–20°. Consequently, the entire housing structure 12 may be tilted so as to achieve different angular orientations depending upon whether or not, for example, an entire group of magazine, newspaper, FEDEX® envelope, or other articles, mail pieces or products 36 are being conveyed along the upper conveying run 28 of the conveyor belt mechanism 22 and across the front surface 18 of the housing structure 12.

Continuing still further, as can best be seen in FIGS. 1–3, it is to be additionally appreciated, in accordance with the principles and teachings of the present invention, that in conjunction with the louvered face plates 48,50,52 through which the vacuum or negative pressure air flow forces are generated for effectively attracting the articles, mail pieces, or products 36 toward, and for effectively adhering the articles, mail pieces, or products 36 upon, the front surface 18 of the housing structure 12, the relatively large upstanding leg portion 16 of the housing structure 12 is further provided with a plurality of vertically spaced positive air plenum chambers 62,64. The positive air plenum chambers 62,64 are fluidically connected to a common positive air plenum chamber 66, and the common positive air plenum chamber 66 is, in turn, fluidically connected to a source of compressed air S. It is noted that the positive air plenum chambers 62,64 are respectively interposed between the vacuum plenum chambers 40,42 and 42,44, and it is further noted that the front surfaces of the positive air plenum chambers 62,64 are provided with perforated face plates 68,70.

Accordingly, when positive pressure air is supplied from the compressed air source S to the positive air plenum chambers 62,64, through means of the common positive air plenum chamber 66, the positive pressure air can be dispersed through the perforated face plates 68,70 so as to effectively interact with the primary side surface portion 58 of each article, mail piece, or product 36 so as to serve as an air bearing means or structure upon which the articles, mail pieces, or products 36 can be disposed so as to achieve the relatively smooth and frictionless or friction-free conveyance or transportation of the articles, mail pieces, or products 36 along the front surface portion 18 of the housing structure 12. As was the case with the vacuum generator VG, the source of compressed air S can supply air at suitable pressure levels, such as, for example, within the range of 2.0–2.5 psi. It is additionally seen that the common positive air plenum chamber 66 has an extension structure 72 which is also fluidically connected to the interior of the conveyor belt mechanism 22 such that an upper perforated surface portion 74 of the plenum chamber extension 72 is disposed directly beneath the upper conveying run 28 of the conveyor belt mechanism 22. In view of the fact that the conveyor belt mechanism 22 is porous, the positive pressure air issuing from the perforated surface portion 74 of the plenum chamber extension 72 can effectively flow through the porous upper conveying run 28 of the conveyor belt mechanism 22 so as to additionally serve as air bearing structure for the lower edge portion 38 of each article, mail piece, or product 36 being conveyed along the upper conveying run 28 of the conveyor belt mechanism 22.

Figure 6:
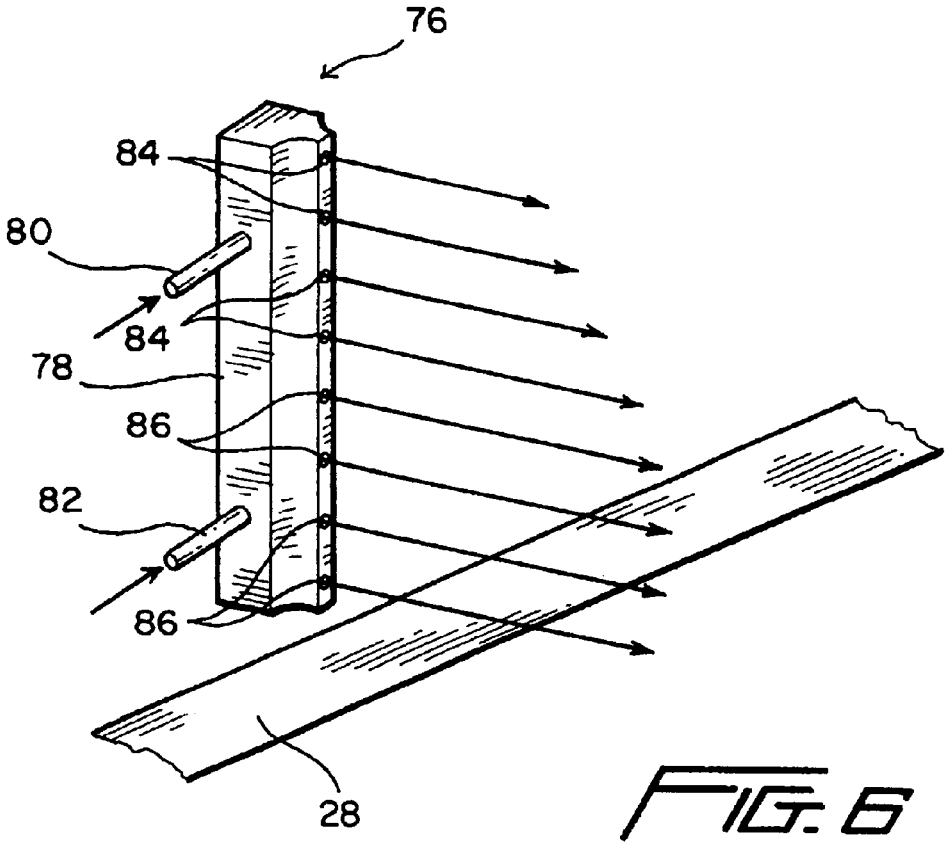
FIG. 6 is a schematic perspective view of a first embodiment of a pneumatic sorter/router mechanism constructed in accordance with the principles and teachings of the present invention for use in connection with the new and improved article, mail piece, or product conveyor or transportation system of the present invention as disclosed within FIGS. 1–3.
Figure 7:
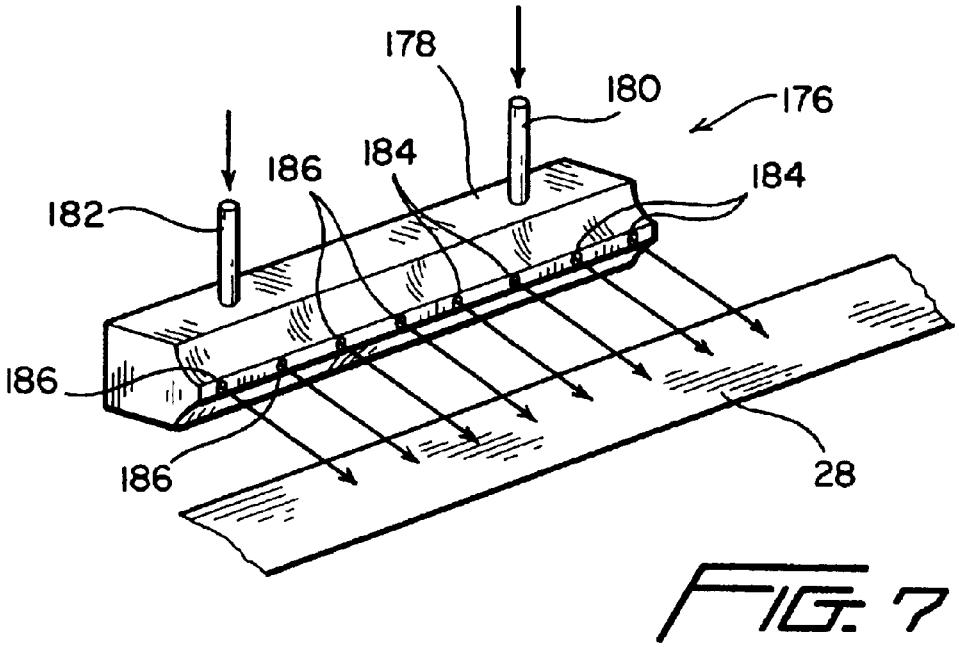
FIG. 7 is a schematic perspective view of a second embodiment of a pneumatic sorter/router mechanism constructed in accordance with the principles and teachings of the present invention for alternative use in connection with the new and improved article, mail piece, or product conveyor or transportation system of the present invention as disclosed within FIGS. 1–3.

With reference lastly being made to FIGS. 6 and 7, there is disclosed two embodiments of air nozzle mechanisms or structures which are adapted to be integrally incorporated within the housing structure 12 such that proper routing or sorting of the articles, mail pieces, or products 36 can in fact be achieved. With reference being firstly made to FIG. 6, the air nozzle mechanism or structure is generally indicated by the reference character 76 and is seen to comprise a vertically oriented or upstanding tubular housing or tower 78 which may be integrally incorporated within the housing structure 12 at predetermined locations along the conveyor belt flow path CBFP as defined, for example, by means of the upper conveying run 28 of the conveyor belt mechanism 22. In this manner, when particular articles, mail pieces, or products 36 are to be routed onto, for example, a different conveying or transportation mechanism, not shown, or alternatively, dispatched into a particular sorting bin or collection receptacle, also not shown, the air nozzle mechanism or structure 76 may be suitably activated. The upstanding tower 78 may have, for example, a pair of vertically spaced pneumatic input or supply connections 80,82 through which, for example, different air flows, at different air pressure values, may be conducted or supplied to interior regions of the tower 78. For example, the upper input or supply connection 80 may be fluidically connected to a suitable source of compressed air which supplies air at a pressure level of 10 psi, while the lower input or supply connection 82 may be fluidically connected to a suitable source of compressed air which supplies air at a pressure level between 10 psi and 20 psi.

The interior of the tower 78 is divided into separate air plenums, not shown, which are respectively fluidically connected to the upper and lower pneumatic input or supply connections 80,82, and it is noted that all pneumatic flow may be controlled by means of suitable electronic control air valve structure, not shown, which may be cycled ON or OFF in accordance with suitable sensor mechanisms, also not shown, which may detect, for example, the conveyance of particular articles, mail pieces, or products 36 in order to achieve the aforenoted routing or sorting of the same. In addition, it is further seen that the tower 78 is provided with two separate vertical arrays of pneumatic output nozzles or discharge ports 84,86 which are respectively fluidically connected to the different input or supply connections 80,82 by means of the air plenums, not shown, disposed within the tower 78. The air flows discharged through the output nozzles or discharge ports 85,86 are conducted toward the upper conveying run 28 of the conveyor belt mechanism 22, and accordingly, as the particularly sensed or designated articles, mail pieces, or products 36, which are to be specifically routed or sorted, are conveyed along the upper conveying run 28 of the conveyor belt mechanism 22, the electronic control air valve structure can be activated so as to supply the compressed air to the intake or supply connections 80,82 for discharge through the output nozzles or discharge ports 84,86.

In accordance with a preferred mode of operation, positive air pressure at a pressure level of 10 psi is supplied to and discharged from the output nozzles or discharge ports 84, however, with respect to the output nozzles or discharge ports 86, positive air pressure at a pressure level of 10 psi may be initially supplied thereto such that the air pressure levels issuing from both sets of output nozzles or discharge ports 84,86 serve to initially begin to cause the articles, mail pieces, or products 36 to be fluidically disengaged from the inclined support surface 18 to which they had been previously attracted or adhered by means of the negative or vacuum suction air supplied to the inclined support surface 18 through means of vacuum plenum chambers 40,42,44 and louvered face plates 48,50,52. Subsequently, the air pressure level of the positive air pressure which is being supplied to and discharged from the output nozzles or discharge ports 86 may be rapidly changed to an air pressure level of, for example, 20 psi in order to assuredly and rapidly disengage and discharge the particular article, mail piece, or product 36 from the inclined support surface 18 and the upper conveying run 28 of the conveyor belt mechanism 22 whereby the particular article, mail piece, or product 36 can in fact be properly routed or sorted. The supply of pressurized air through the supply connection 82 may be subsequently reduced back to a pressure level of 10 psi in preparation for the routing or sorting of the next article, mail piece, or product 36, or alternatively, the entire air supply may be terminated in accordance with the cyclic ON and OFF of the suitable electronic control air valve structure, not shown, if according to the aforenoted sensor structure, not shown, none of the oncoming articles, mail pieces, or products 36 need to be particularly routed or sorted at this particular location along the longitudinal extent of the conveyor belt mechanism 22.

With reference similarly being made to FIG. 7, it is to be appreciated that a second, alternative embodiment of an air nozzle mechanism or structure is illustrated and is generally by the reference character 176. It is to be noted that the second, alternative embodiment of the air nozzle mechanism or structure 176 as illustrated in FIG. 7 is similar to the first embodiment of the air nozzle mechanism or structure 76 as illustrated within FIG. 6, and consequently, a complete detailed disclosure of the same will be omitted herefrom for brevity purposes. It is accordingly noted that component parts of the second, alternative embodiment of the air nozzle mechanism or structure 176, which correspond to the component parts of the first embodiment of the air nozzle mechanism or structure 76 will be designated by corresponding reference characters except that the reference characters will be in the 100 series. Accordingly, it is noted that, as was the case with the first embodiment of the air nozzle mechanism or structure 76 as illustrated within FIG. 6, the second embodiment of the air nozzle mechanism or structure 176 as disclosed within FIG. 7 is likewise adapted to be integrally incorporated within the housing structure 12 such that proper routing or sorting of the articles, mail pieces, or products 36 can in fact be achieved. The only significant difference between the first embodiment of the air nozzle mechanism or structure 76 as illustrated within FIG. 6, and the second embodiment of the air nozzle mechanism or structure 176 as illustrated within FIG. 7, resides in the fact that the second embodiment of the air nozzle mechanism or structure 176 comprises a manifold oriented horizontally along the conveyor belt flow path CBFP as opposed to the aforenoted vertically oriented tower 76. In this manner, the lower pressure air being discharged from the output nozzles or discharge ports 184, 186, that is, the air flows having pressure levels of 10 psi, are able to act upon the conveyed articles, mail pieces, or products 36 during a somewhat greater or lengthened period of time, in order to preliminarily disengage the same from the inclined support surface 18, prior to the discharge of the air flows from the output nozzles or discharge ports 186 at the relatively higher pressure level of 20 psi for ensuring the actual discharge of the particular articles, mail pieces, or products 36 from the inclined support surface 18 and the conveyor belt mechanism 22.

Thus, it may be seen that in accordance with the principles and teachings of the present invention, there has been provided a new and improved article, mail piece, or product conveyor or transportation system wherein a conveyor mechanism has a substantially horizontally oriented conveyor or product transportation surface upon which the articles, mail pieces, or products can be conveyed or transported in an upstanding mode as a result of the articles, mail pieces, or products effectively being supported upon lower edge portions thereof, and an inclined surface against which the major or primary surface portions, surface regions, or mass of each article, mail piece, or product is supported so as to permit the articles, mail pieces, or products to be readily and easily conveyed or transported by means of the horizontally oriented conveyor or product transportation surface. The vacuum plenum chambers, through which air is effectively withdrawn from the article, mail piece, or product conveyor or transportation path, effectively maintains the articles, mail pieces, or products attracted to or adhered upon the inclined surface of the product transportation system, and the pneumatic supply plenums, through which air is effectively simultaneously supplied to the article, mail piece, or product conveying or transportation path, effectively forms an air bearing structure for the articles, mail pieces, or products so as to facilitate the smooth and easy conveyance or transportation of such articles, mail pieces, or products along the conveyor or product transportation flow path in a substantially frictionless or friction-free manner.

Still further, the entire article, mail piece, or product conveyor or transportation system is pivotal around a lower corner region thereof so as to effectively alter the relative inclination of both the horizontally oriented conveyor or product transportation surface, upon which the articles, mail pieces, or products are conveyed or transported, as well as the inclined surface against which the major or primary surface portions, surface regions, or mass of each article, mail piece, or product are supported. In this manner, predetermined alterations can be made to the article, mail piece, or product conveyor or transportation system in order to partially adjust the gravitational support or weight distributions of the diverse articles, mail pieces, or products being conveyed along the horizontally oriented conveyor or product transportation surface. Accordingly, regardless of the weight of any of the particular articles, mail pieces, or products being conveyed by means of the conveyor or transportation system, all articles, mail pieces, or products can be readily, easily, and quickly conveyed or transported along the horizontally oriented conveyor or product transportation surface so as to achieve the ultimate routing, sorting, and further processing of the articles, mail pieces, or products. Air output nozzles or discharge ports also ensure the actual discharge of the articles, mail pieces, or products from the conveyor mechanism in order to achieve the routing or sorting of the articles, mail pieces, or products.

It is lastly noted that, in light of the foregoing disclosure, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. An article conveyor system, comprising:

substantially horizontally disposed conveyor means for conveying articles along a conveyor flow path as a result of the articles being supported upon said substantially horizontally disposed conveyor means by lower edge portions of the articles;

vertically upstanding support surface means for supporting side surface portions of the articles as the articles are conveyed along said conveyor flow path by said substantially horizontally disposed conveyor means;

vacuum means fluidically connected to said vertically upstanding support surface means for withdrawing ambient air from said conveyor flow path so as to effectively attract the articles toward said vertically upstanding support surface means; and air pressure means fluidically connected to said vertically upstanding support surface means for establishing air bearing means along said conveyor flow path so as to facilitate the conveyance of the articles along said conveyor flow path in a substantially frictionless manner.

2. The article conveyor system as set forth in claim 1, wherein:

said substantially horizontally disposed conveyor means comprises an endless loop conveyor belt.

3. The article conveyor system as set forth in claim 2, wherein:

said endless loop conveyor belt comprises a pair of opposite end portions respectively disposed around a pair of conveyor rollers, a lower run conveyor belt portion, and an upper run conveyor belt portion upon which the lower edge portions of the articles are supported.

4. The article conveyor system as set forth in claim 3, wherein:

said vertically upstanding support surface means is disposed upon a front surface portion of a housing structure;

said vacuum means fluidically connected to said vertically upstanding support surface means comprises vacuum plenum means; and said air pressure means fluidically connected to said vertically upstanding support surface means comprises positive air pressure plenum means.

5. The article conveyor system as set forth in claim 4, wherein:

said vacuum plenum means comprises a plurality of vertically spaced vacuum plenum chambers; and said air pressure means comprises a plurality of vertically spaced positive air pressure plenum chambers.

6. The article conveyor system as set forth in claim 5, wherein:

said plurality of vertically spaced positive air pressure plenum chambers are respectively interposed between said plurality of vertically spaced vacuum plenum chambers.

7. The article conveyor system as set forth in claim 6, wherein:

said housing structure has a substantially L-shaped cross-sectional configuration.

8. The article conveyor system as set forth in claim 7, wherein said substantially L-shaped housing structure comprises:

a relatively short, horizontally oriented leg section for defining a ledge portion above which said endless loop conveyor is rotatably disposed; and a relatively long, vertically oriented leg section within which said vacuum plenum chambers and said positive air pressure plenum chambers are disposed.

9. The article conveyor system as set forth in claim 4, wherein:

said vertically upstanding support surface means, for supporting the side surface portions of the articles as the articles are conveyed along said conveyor flow path by said substantially horizontally disposed conveyor means, is disposed at a predetermined inclined angle with respect to a true vertical plane; and said upper run portion of said endless loop conveyor belt, upon which the lower edge portions of the articles are conveyingly supported, is disposed at a predetermined inclined angle with respect to a true horizontal plane.

10. The article conveyor system as set forth in claim 9, wherein:

said predetermined inclined angles of said vertically upstanding support surface means and said upper run portion of said endless loop conveyor belt is within the range of 5–20°.

11. The article conveyor system as set forth in claim 10, further comprising:

means operatively connected to said housing structure for pivotally moving said housing structure around a substantially horizontal axis so as to predeterminedly alter said inclined angles of said vertically upstanding support surface means and said upper run portion of said endless loop conveyor belt within said angular range of 5–20°.

12. The article conveyor system as set forth in claim 1, further comprising:

additional air pressure means fluidically connected to said substantially horizontally disposed conveyor means for establishing air bearing means along said conveyor flow path so as to facilitate the conveyance of the articles along said conveyor flow path in a substantially frictionless manner.

13. The article conveyor system as set forth in claim 1, further comprising:

pneumatic means operatively associated with said vertically upstanding support surface means for impinging air flows upon the articles, at predetermined locations along said conveyor flow path, as the articles are conveyed along said vertically upstanding support surface and said conveyor flow path by said substantially horizontally disposed conveyor means so as to discharge the articles from said horizontally disposed conveyor means in order to properly route the articles.

14. The article conveyor system as set forth in claim 13, wherein:

said pneumatic means comprises a vertically oriented tower integrally incorporated within said vertically upstanding support surface and having a plurality of air discharge ports defined therein.

15. The article conveyor system as set forth in claim 13, wherein:

said pneumatic means comprises a horizontally oriented manifold integrally incorporated within said vertically upstanding support surface and having a plurality of air discharge ports defined therein.

16. The article conveyor system as set forth in claim 1, wherein:

said articles comprise mail pieces.

17. The article conveyor system as set forth in claim 16, wherein:

said mail pieces comprise individual articles selected from the group comprising newspapers, magazines, literature, greeting card packages, pharmaceutical packages, and oversize envelopes.

18. A method of conveying articles, comprising the steps of:

providing substantially horizontally disposed conveyor means for conveying articles along a conveyor flow path as a result of the articles being supported upon said substantially horizontally disposed conveyor means by lower edge portions of the articles;

supporting side surface portions of the articles against vertically upstanding support surface means as the articles are conveyed along said conveyor flow path by said substantially horizontally disposed conveyor means;

providing vacuum means fluidically connected to said vertically upstanding support surface means for withdrawing ambient air from said conveyor flow path so as to effectively attract the articles toward said vertically upstanding support surface means; and providing air pressure means fluidically connected to said vertically upstanding support surface means for establishing air bearing means along said conveyor flow path so as to facilitate the conveyance of the articles along said conveyor flow path in a substantially frictionless manner.

19. The article conveying method as set forth in claim 18, further comprising the step of:

providing said substantially horizontally disposed conveyor means as an endless loop conveyor belt.

20. The article conveying method as set forth in claim 19, further comprising the step of:

routing a pair of opposite end portions of said endless loop conveyor belt respectively around a pair of conveyor rollers so as to form a lower run conveyor belt portion, and an upper run conveyor belt portion upon which the lower edge portions of the articles are supported.

21. The article conveying method as set forth in claim 20, further comprising the steps of:

forming said vertically upstanding support surface means as a front surface portion of a housing structure;

fluidically connecting said vacuum means to said vertically upstanding support surface means by vacuum plenum means; and fluidically connecting said air pressure means to said vertically upstanding support surface means by positive air pressure plenum means.

22. The article conveying method as set forth in claim 21, further comprising the steps of:

forming said vacuum plenum means as a plurality of vertically spaced vacuum plenum chambers; and forming said air pressure means as a plurality of vertically spaced positive air pressure plenum chambers.

23. The article conveying method as set forth in claim 22, further comprising the step of:

respectively interposing said plurality of vertically spaced positive air pressure plenum chambers between said plurality of vertically spaced vacuum plenum chambers.

24. The article conveying method as set forth in claim 23, further comprising the step of:

forming said housing structure so as to have a substantially L-shaped cross-sectional configuration comprising a relatively short, horizontally oriented leg section for defining a ledge portion above which said endless loop conveyor is rotatably disposed, and a relatively long, vertically oriented leg section within which said vacuum plenum chambers and said positive air pressure plenum chambers are disposed.

25. The article conveying method as set forth in claim 21, further comprising the steps of:

disposing said vertically upstanding support surface means, for supporting the side surface portions of the articles as the articles are conveyed along said conveyor flow path by said substantially horizontally disposed conveyor means, at a predetermined inclined angle with respect to a true vertical plane; and disposing said upper run portion of said endless loop conveyor belt, upon which the lower edge portions of the articles are conveyingly supported, at a predetermined inclined angle with respect to a true horizontal plane.

26. The article conveying method as set forth in claim 25, further comprising the step of:

pivotally moving said housing structure around a substantially horizontal axis so as to predeterminedly alter said inclined angles of said vertically upstanding support surface means and said upper run portion of said endless loop conveyor belt within an angular range of 5–20°.

27. The article conveying method as set forth in claim 18, further comprising the step of:

fluidically connecting additional air pressure means to said substantially horizontally disposed conveyor means for establishing air bearing means along said conveyor flow path so as to facilitate the conveyance of the articles along said conveyor flow path in a substantially frictionless manner.

28. The article conveying method as set forth in claim 18, further comprising the step of:

operatively connecting pneumatic means with said vertically upstanding support surface means for impinging air flows upon the articles at predetermined locations along said conveyor flow path as the articles are conveyed along said vertically upstanding support surface and said conveyor flow path by said substantially horizontally disposed conveyor means so as to discharge the articles from said horizontally disposed conveyor means in order to properly route the articles.

* * * * *